US006040771A

United States Patent [19]

Kim

[11] Patent Number: 6,040,771

[45] Date of Patent: Mar. 21, 2000

[54] INTELLIGENT SAFE SYSTEM

[76] Inventor: Jitae Kim, 23212 Park Corniche, Calabasas, Calif. 91302

[21] Appl. No.: 08/723,862

[22] Filed: Sep. 30, 1996

[30] Foreign Application Priority Data

Dec. 2, 1995 [KR] Rep. of Korea ..... 95-46144

[51] Int. Cl.[7] ..... G08B 13/08

[52] U.S. Cl. ..... 340/545; 340/541; 340/542; 340/543; 340/825.32; 70/277; 379/103; 341/176

[58] Field of Search ..... 340/545, 541, 340/542, 543, 693, 825.31, 825.32; 129/21, 38; 70/655, 277, 280; 341/176; 364/146, 184; 379/103

[56] References Cited

U.S. PATENT DOCUMENTS

| | | | |
|---|---|---|---|
| 3,659,265 | 4/1972 | Eversull | 340/429 |
| 3,877,266 | 4/1975 | McLaughlin | 70/280 |
| 3,881,171 | 4/1975 | Moorman et al. | 340/825.32 |
| 4,214,485 | 7/1980 | Berger et al. | 73/655 |
| 4,271,407 | 6/1981 | Kehrman et al. | 340/690 |
| 4,683,753 | 8/1987 | Nelsen et al. | 73/655 |
| 4,755,801 | 7/1988 | Gooley | 340/566 |
| 4,772,877 | 9/1988 | Rice, Jr. et al. | 340/543 |
| 4,887,078 | 12/1989 | Cho | 340/825.48 |
| 4,986,099 | 1/1991 | Johnson et al. | 70/277 |
| 5,070,442 | 12/1991 | Syron-Townson et al. | 364/146 |
| 5,117,223 | 5/1992 | Tanner | 340/693 |
| 5,410,295 | 4/1995 | Van Lint | 340/568 |
| 5,469,141 | 11/1995 | Ghazarian | 340/566 |
| 5,479,341 | 12/1995 | Pihl et al. | 364/184 |

*Primary Examiner*—Jeffery A. Hofsass
*Assistant Examiner*—Benjamin C. Lee
*Attorney, Agent, or Firm*—Erik M. Arnhem

[57] ABSTRACT

An intelligent safe system. The safe system includes a safe including a housing and lockable door thereto, a central processing unit for controlling access to the safe by operating the lockable door, a card reader for reading access codes from an access card to control the lockable door, a sensor for detecting security violations, a modem for transmitting alarm signals from the CPU to indicate a security violation and for receiving external control data to lock or open the lockable door, and an audio alarm device for indicating security violations. The central processing unit may further includes a memory for storing the card numbers. A sensor may be coupled to the housing for detecting the locking an opening of the lockable door. A display may also be coupled to the housing for displaying acceptance of access codes. Further, the safe system also includes a sensor. The sensor may include a horizontal detection sensor for detecting horizontal movement of the housing, a shock-detection sensor for detecting shock inflicted to the safe, and a thermo-detection sensor for detecting thermo-conditions being inflicted to the safe.

3 Claims, 2 Drawing Sheets

INTELLIGENT SAFE SYSTEM

BACKGROUND OF THE INVENTION

1. Field of the Invention

This invention relates in general to a safe, and more particularly, to an intelligent safe having a sensor system and remote control for preventing unauthorized access to the contents therein.

2. Description of Related Art

Safe systems have become increasingly sophisticated in recent years. Advancements in the areas of alarm systems and computer controlled access systems have improved the security provided by safe systems. For example, alarm systems for detecting forced entry and which may be connected to security services or directly to local law enforcement have been used for premise security for a number of years. In addition, digital card access systems are widely available.

Nevertheless, safe systems may still be vulnerable to rather easy access by any unwanted person if the owner of a safe system loses his key or if access numbers are exposed. For example, an owner of a safe system may discover when on a long trip or away from the home or office, that the key to the safe system has been misplace or that secret dial numbers have been exposed. In this situation, the safe system owner has no alternative course to stop the intruder's access. Even if the safe is strongly manufactured, no effective measure can be taken to prevent it.

Furthermore, in the past, a vehicle or safe's theft prevention sensor system was not able to detect the object's lapping or horizontal level change due to movement. Hence, if the vehicle or safe is stolen and carried by large container as a whole without breakage, there was no effective way of sensing the movement.

Thus, it can be seen that there is a need for a safe system which provides added security to prevent compromise in the event the means for opening the safe falls into sinister hands.

It can also be seen that there is a need for a sensor system to detect an object's lapping and horizontal level change.

SUMMARY OF THE INVENTION

To overcome the limitations in the prior art described above, and to overcome other limitations that will become apparent upon reading and understanding the present specification, the present invention discloses an intelligent safe system.

The present invention solves the above-described problems by providing a local and remote control of access to the safe system and by providing a horizontal motion sensor to detect movement of the safe system.

A system in accordance with the principles of the present invention includes a safe including a housing and lockable door thereto, a central processing unit for controlling access to the safe by operating the lockable door, a card reader for reading access codes from an access card to control the lockable door, a sensor for detecting security violations, a modem for transmitting alarm signals from the CPU to indicate a security violation and for receiving external control data to lock or open the lockable door, and an audio alarm device for indicating security violations.

One aspect of the present invention is that the central processing unit further comprises a memory for storing the card numbers.

Another aspect of the present invention is that a sensor is coupled to the housing for detecting the locking an opening of the lockable door.

Another aspect of the present invention is that a display is coupled to the housing for displaying acceptance of access codes.

Another aspect of the present invention is that the sensor may further include a horizontal detection sensor for detecting horizontal movement of the housing, a shock-detection sensor for detecting shock inflicted to the safe, and a thermo-detection sensor for detecting thermo-conditions being inflicted to the safe.

Yet another aspect of the present invention is that the card comprises a series of ten numbers.

Another aspect of the present invention is that the external control data to lock or open the lockable door comprises DTMF tones selected using the keys of a telephone keypad.

Another aspect of the present invention is that the external keypad is coupled to the housing for entering access numbers to control the operation of the lockable door.

Still another aspect of the present invention is that the central processing unit controls opening and closing of the lockable door according to two levels, a first level being the entry of data from a card and a second level being receiving remote external data.

Another aspect of the present invention is that the horizontal detection sensor further comprises a first detector, the first detector comprising a first conducting pendulum electrode being suspended by an electrical wire and a second electrode configured to surround the suspended pendulum, wherein movement of the housing causes the first electrode to contact the second electrode, current flowing between the electrodes when contact is made.

Another aspect of the present invention is that the horizontal detection sensor further comprises an infrared receiver, an infrared transmitter, and a mercury container disposed between the infrared receiver and transmitter, wherein the movement of the housing causes the mercury in the mercury container to be driven to the sides, the driving of the mercury to the sides of the container allowing the infrared receiver to detect a signal from the infrared transmitter, the receiver sending a data signal to the central processing unit indicating movement of the housing.

Another aspect of the present invention is that the central processing unit compares the signal from the suspended pendulum to the signal from the infrared receiver, signals are the same.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there is illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

The present invention provides a safe, which recognizes when an attempt to move, damage, destroy or any problematic outer force is caused to the safe by an unwanted intruder, automatically activates alarm device such as a siren, and transmits an alarm signal to a police box or security agent connected with the system through prescribed secret numbers.

Figure 1:
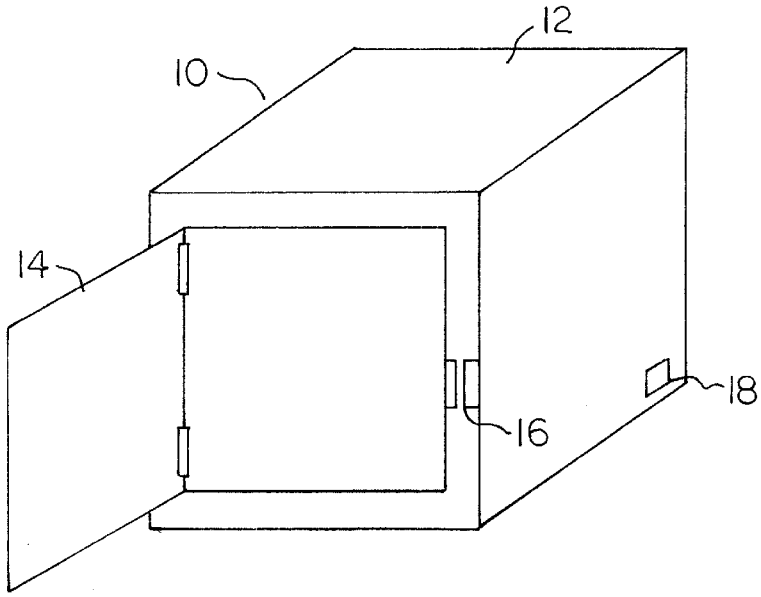
FIG. 1 illustrates an exemplary safe system according to the present invention.

FIG. 1 illustrates an exemplary safe system 10 according to the present invention. The safe system includes a housing 12 and lockable door 14. An external data entry device 16 such as a card reader or smart card reader (i.e., integrated circuit card reader) for accessing the safe system 10 may be located near the lockable door 14. A telephone communication device 18, such as a telephone line connector (e.g., RJ-45) or alternatively an antenna in the case of RF, wireless telephony and/or paging, is disposed externally on the housing 12 to provide data input/output to the safe system 10.

Figure 2:
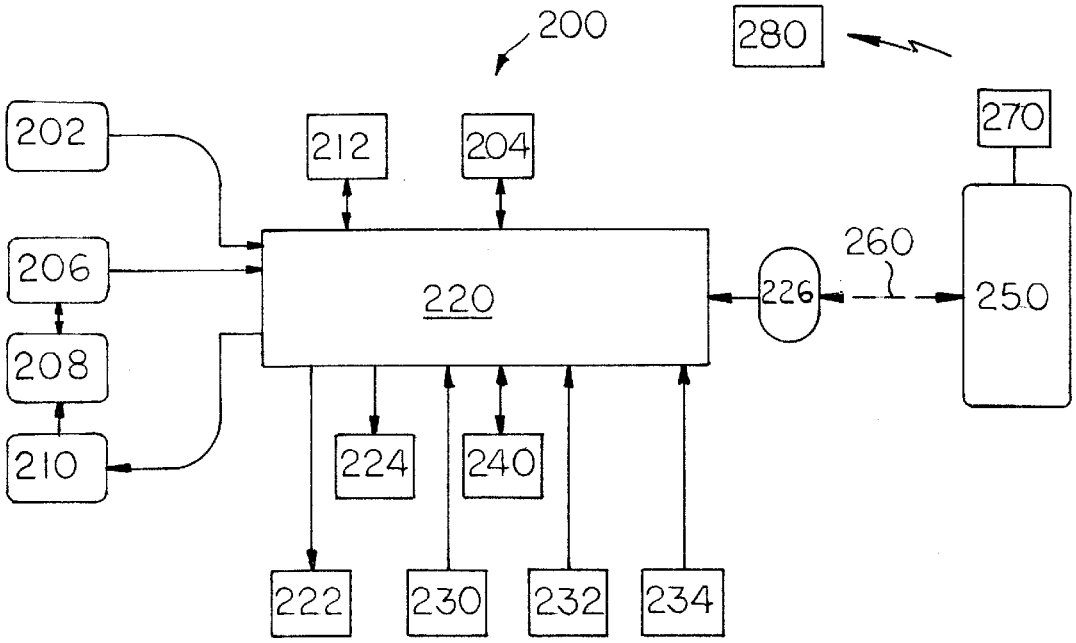
FIG. 2 is a block diagram of the safe system according the present invention.

FIG. 2 illustrates a block diagram 200 of the safe system according to the present invention. A data entry device 202 recognizes entered numbers that function as a key. The data entry device 202 may read numbers stored on a magnetic strip or from an integrated circuit on a card (i.e., smart card). A sensor 206 recognizes access codes or numbers and provides them to a central processing unit 220. For a magnetic strip, the data entry device 202 senses a data pattern stored on the magnetic strip. For a smart card, the data entry device 202 may access the integrated circuit through direct physical contact or via inductive coupling techniques. The integrated circuit sensed by the data entry device 202 may include read-only memory (ROM), read/write memory, or a combination of both.

A memory ram 204 stores acceptable access numbers. The central processing unit 220 compares the code sensed by the data entry device 202 to the stored access numbers. A display 222 may be used to display the data sensed by the sensor 206 and a control device 210 controls a locking system 208 of the safe.

A timing device 224 may be provided to measure the operating time of the locking system 208. A data transmission device 226, such as a signal modem, RF transmitter or transceiver, may be used to transmit and receive data. The safe system 200 may also include a telephone communication device 250 for transmitting and receiving data. The telephone communication device 250 may be coupled to a telephone connector or antenna 270 disposed at the exterior of the system 200. Thus, the safe system 200 may be directly connected to telephone lines via the connector 270. Alternatively, the telephone communication device 250 may be a wireless telephone circuit or other RF transmitter for transmitting and receiving signals via an antenna 270. Furthermore, the system 200 may include a remote receiver/alarm device 280 which may be controlled by the telephone communication device 250. Still further, the telephone communication device 250 may comprise a paging circuit such as a two-way pager. Accordingly, paging signals may be used to control access to the safe system 200 and to activate alarms.

The safe system 200 includes sensors 230, 232, 234 for providing added security. A shock-detection sensor 230 detects any shock to the safe, a thermo-detection sensor 232 detects temperature inflicted to the safe, and a horizontal-detection sensor 234 detects horizontal motion. The horizontal detection sensor is discussed in greater detail below with reference to FIGS. 3–4. Upon activation by the sensors detecting abnormal conditions, an audio-alarm device 240 transmits an audio-alarm signal. The central processing unit 220 is used to control all of the functions described above. A main memory 212 is used to store the programs for the CPU 220 and any other data used by the system 200.

Now an explanation of the operation of the present invention will be provided. First, the opening and closing function will be described. A card user closes the door of the safe and inserts a card into card-reader 202. Card-reader 202 recognizes the card's card numbers and transmits the data to a central processing unit 220. The CPU 220 stores the card numbers in the memory 204, and orders a control device 210 to close the locking system 208. Then the sensor 206 recognizes that the locking system 208 is closed, and displays an indication 222 that the safe is closed.

When card user wants to open the safe, he inserts into the card-reader 202 the card used during the closing process. The card-reader then recognizes the card's card numbers and transmits them to the CPU 220. The CPU 220 checks whether the read data is the same as stored in the memory 204. If the data matches, the CPU 220 orders the control device 210 to open the locking system 208.

However, when the card numbers read by the card-reader 202 are not same as the one stored in the memory 204, the CPU 220 shows an error in the display 222 and remains silent, thereby prohibiting the safe from being opened.

In addition, the safe system provides automatic detection functions. When opening or closing the safe, the card numbers used are stored on consecutively in the memory 204. If the storage capability of memory 204 is exceeded, earlier memories are erased and replaced with new card numbers in series. Accordingly, as the user is able to recognize easily the card numbers used in a time series, he knows which numbers are used in opening and closing the safe.

Further, the safe system may detect unwarranted attempts to destroy the safe system. When an intruder attempts to destroy the safe system, the shock detection sensor 230 transmits its data to the CPU 220 which distinguishes the shock-level and repeated numbers of shock. If the CPU 220 detects that the shocks are stronger than normal levels which have been pre-programmed, then the CPU 220 orders activation of an audio-alarm device 240, such as a siren, along with transmitting its alarm signal to a police box or security agent or its owner via telephone communication device 250 and signal modem 226.

If the intruder attempts to move the safe system, the horizontal-detection sensor 234 detects the movement and transmits appropriate data to the CPU 220 via pre-programmed telephone numbers. The CPU 220 recognizes the data and immediately activates the audio-alarm device. Additionally, if the intruder attempts to open the safe, such as by using a welding kit, the thermo-detection sensor 232 detects the increased heat and transmits also appropriate data to the CPU 220 to operate an automatic activation of an alarm device, and to transmit an indication to a police box or its owner via telephone.

The safe system 200 also includes remote-control functions. The owner is able to open and close the safe by remote-control via telephone. When an owner loses the entry card or, alternatively, does not want to use the safe for a long period of time, the owner may telephone the CPU 220 and enter a code to instruct the CPU 220 not to open the safe. The code includes DTMF tone sent via telephone communication device 250 and its signal modem 226.

This instruction acts as a double locking process since the CPU 220 instructs the locking control device 210 not to open the safe even with owner's card key. Thus, if the owner loses the card used in the closing of the safe during a trip, the safe may be prevented from opening by way of activating such a remote-control device.

Furthermore, when the shock-detection sensor 230, thermo-detection sensor 232 or horizontal-detection sensor 234 activate the audio-alarm device 240 by the CPU 220, and the owner needs to stop this continued activation upon receipt of its alarming, the owner dials a telephone to transmit confidential deactivation numbers to the CPU 220 to stop it. The deactivation numbers are pre-programmed into the memory 204 and the CPU 220 compares the deactivation code to the stored code to verify proper deactivation commands.

Figure 3:
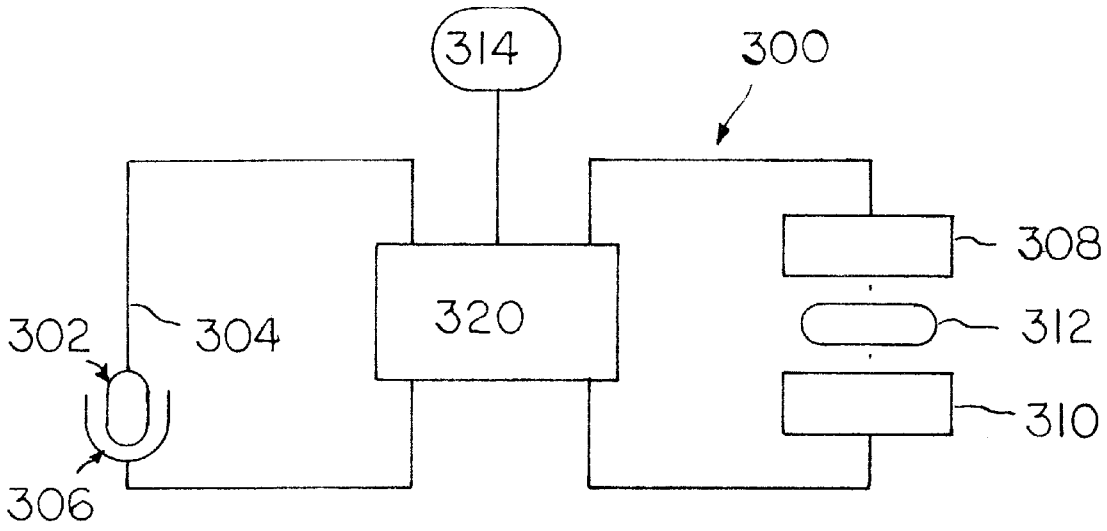
FIG. 3 illustrates a safe system according to the present invention provided with a horizontal movement sensor.

FIG. 3 illustrates a safe system 300 according to the present invention provided with a horizontal movement sensor as mentioned above. FIG. 3 shows the cylindrically shaped weight pendulum 302 being connected at the bottom of the electrical wire 304 and the invention also consist of cylindrically shaped electrode 306. In FIG. 3, the invention is shown to also include an infrared ray transmitter 308, infrared ray receiver 310, cylindrically shaped mercury container 312 containing thinly spread mercury, alarm device 314 and central processing unit 320.

Figure 4:
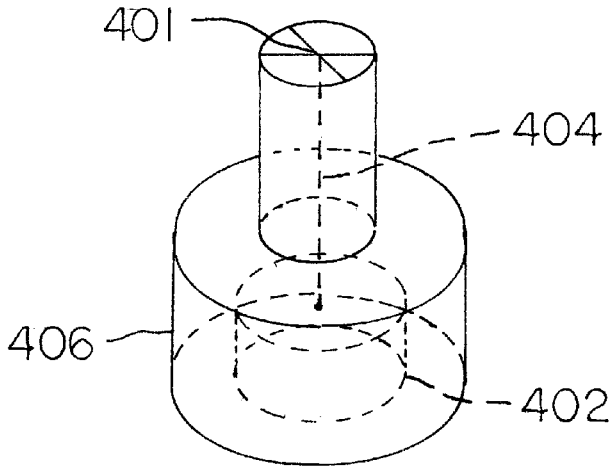
FIG. 4 is schematic view of the weight pendulum system of FIG. 3.

FIG. 4 is schematic view of a weight pendulum system. As FIG. 4 shows the invention consist of fixed center axis 401 and thin electrical wire 404 hung at fixed center axis 401. Cylindrically shaped weight pendulum 402 is connected at the bottom of the electrical wire 404 within a hollow cylindrically shaped electrode 406.

Referring to FIG. 4, if the objects like vehicle or safe attached with invented sensor is moved, by the law of inertia, cylindrically shaped weight pendulum 402 hung by thin electrical wire 404 from fixed center axis 401 goes into standstill state while surrounding cylindrically shaped electrode 406 moves and gets into contact with standstill cylindrically shaped weight pendulum 402. Consequently, electrical current flows between electrical wire 404 and cylindrically shaped electrode 406. Now referring to FIG. 3, the central processing unit 320 detects the flowing current through wire 304.

With respect to FIG. 3, the laws of gravitation pulls cylindrically shaped weight pendulum 3 hung by thin electrical wire 304 towards earth center when the object's (vehicles or safes) horizontal level deviates because of movement. Consequently, if the object does not keep the horizontal level, cylindrically shaped electrode 306 gets into contact with cylindrically shaped weight pendulum 302 and electric current flows through electrical wire 304 and central processing unit 320 detects the electric current.

Furthermore, when the object is lapping, thin mercury of cylindrically shaped mercury container 312 located between infrared ray transmitter 308 and infrared ray receiver 310 begins lapping and mercury is driven to the sides. Then, the intercepted infrared ray due to the presence of mercury goes through the cylindrically shaped mercury container 312 and infrared ray receiver 310 receives the transmitted infrared ray and sends the data signal to the central processing unit 320 thus detecting the object's lapping.

Still further, if the object's horizontal level is not kept, mercury is consistently driven to the sides and infrared ray gets through the cylindrically shaped mercury container 312, thus, object's horizontal level condition is detected.

As explained above, according to the invention, if the object attached with the invented sensor moves or laps or horizontal level changes, then cylindrically shaped weight pendulum 302 hung by thin wire 304 and surrounding cylindrically shaped electrode 306 gets into contact and at the same time, infrared ray receiver 310 sends the data signal penetrated through the cylindrically shaped mercury container 312 to the central processing unit 320. Then the central processing unit 320 compares the detected data signal from the cylindrically shaped weight pendulum 302 and only if the two data are identical then the signal is processed as a genuine and starts alarm device 7 and eliminates the error from the sensor.

In summary, an intelligent safe system has been disclosed which provides local and remote control of access to the safe system and which may provide two levels of security. A horizontal motion sensor is also provided to detect movement of the safe system.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. An intelligent safe system, comprising:

a safe door locking means (208);

a central processing unit (220) for operating said door locking means to the door-unlocked condition;

a memory (204) coupled to said central processing unit, said memory comprising stored activation codes for activating said central processing unit, and a stored deactivation code for cancelling the action of the stored activating codes;

a data entry device (202) coupled to said central processing unit for delivering user-generated actuation codes to said central processing unit;

said central processing unit having a code-comparing capability for delivering an operating signal to said door-locking means when a user-generated activation code is the same as a stored activation code;

a remotely-accessed data transmission telephone means comprising a modem (226) coupled to said central processing unit for delivering an owner-generated deactivation code from a remote area to said central processing unit;

said telephone means comprising a telephone transmitter and means for inputting a DTMF tone deactivation code to said telephone transmitter for delivery to said modem;

said central processing unit having a code-comparing capability for comparing the owner-generated deactivation code with the stored deactivation code, to produce an override signal when the owner-generated deactivation code and the stored deactivation code are the same;

said central processing unit being responsive to said override signal to cancel any operating signal that might otherwise produce a door-unlocking action.

2. The safe system of claim 1, and further comprising sensor means (234) for detecting unauthorized movement of the safe;

said sensor means comprising first and second detectors;

said first detector comprising a conductive pendulum electrode, a conductive suspension wire for said pendulum electrode, and a stationary electrode surrounding the pendulum electrode, whereby movement of the pendulum electrode into contact with the stationary electrode generates a first error signal;

said second detector comprising an infrared receiver, and infrared transmitter, and a mercury container disposed between said receiver and said infrared transmitter so that the mercury in said container normally obstructs infrared transmission to the receiver; said mercury being displaceable in response to movement of the safe so that the mercury is in a non-obstructing condition permitting the passage of infrared energy to said infrared receiver, whereby a second error signal is generated.

3. The safe system of claim 2, wherein said central processing unit includes means for comparing said first and second error signals, to generate an alarm signal when said error signals match.

* * * * *